US010242697B2

(12) United States Patent
Okuyama

(10) Patent No.: US 10,242,697 B2
(45) Date of Patent: Mar. 26, 2019

(54) PITCH INFORMATION GENERATION DEVICE, PITCH INFORMATION GENERATION METHOD, AND COMPUTER-READABLE RECORDING MEDIUM THEREFOR

(71) Applicant: YAMAHA CORPORATION, Hamamatsu-shi (JP)

(72) Inventor: Fukutaro Okuyama, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 82 days.

(21) Appl. No.: 15/336,123

(22) Filed: Oct. 27, 2016

(65) Prior Publication Data

US 2017/0047083 A1 Feb. 16, 2017

Related U.S. Application Data

(63) Continuation of application No. PCT/JP2015/062968, filed on Apr. 30, 2015.

(30) Foreign Application Priority Data

Apr. 30, 2014 (JP) ..... 2014-093734

(51) Int. Cl.
*G10L 25/90* (2013.01)
*G10G 7/02* (2006.01)
(Continued)

(52) U.S. Cl.
CPC ..... *G10L 25/90* (2013.01); *G10G 7/02* (2013.01); *G10H 1/44* (2013.01); *G10H 3/125* (2013.01);
(Continued)

(58) Field of Classification Search
USPC ..... 704/205–209
See application file for complete search history.

(56) References Cited

U.S. PATENT DOCUMENTS 7,613,612 B2 * 11/2009 Kemmochi ..... G10L 13/06 704/205
2004/0221710 A1 11/2004 Kitayama
(Continued)

FOREIGN PATENT DOCUMENTS

JP H01101600 A 4/1989
JP H0997071 A 4/1997
(Continued)

OTHER PUBLICATIONS

International Search Report issued in Intl. Appln. No. PCT/JP2015/062968, dated Jul. 21, 2015. English translation provided.
(Continued)

*Primary Examiner* — Leonard Saint Cyr
(74) *Attorney, Agent, or Firm* — Rossi, Kimms & McDowell LLP

(57) ABSTRACT

A pitch information generation device includes a first envelope generator configured to generate, with regard to a first sound range, a first envelope that attenuates at a first rate of change from a detected value corresponding to a peak in the sound signal, a second envelope generator configured to generate, with regard to a second sound range, which includes a sound range of higher frequency than the first sound range, a second envelope that attenuates from a detected value corresponding to a peak in the sound signal at a second rate of change. The second rate of change is greater than the first rate of change. A pitch information identifier is configured to identify the pitch information based on the first envelope and the second envelope.

9 Claims, 9 Drawing Sheets

(51) Int. Cl.

| | |
|---|---|
| ***G10L 21/007*** | (2013.01) |
| ***G10H 1/44*** | (2006.01) |
| ***G10H 3/12*** | (2006.01) |
| *G10L 25/15* | (2013.01) |

(52) U.S. Cl.
CPC ..... *G10L 21/007* (2013.01); *G10L 25/15* (2013.01); *G10L 2025/906* (2013.01)

(56) References Cited

U.S. PATENT DOCUMENTS

| | | | | |
|---|---|---|---|---|
| 2006/0173676 | A1* | 8/2006 | Kemmochi | G10L 13/06 704/207 |
| 2006/0212298 | A1* | 9/2006 | Kemmochi | G10H 1/10 704/278 |
| 2014/0086420 | A1 | 3/2014 | Bradley et al. | |

FOREIGN PATENT DOCUMENTS

| | | | |
|---|---|---|---|
| JP | H11311988 | A | 11/1999 |
| JP | 2005157257 | A | 6/2005 |
| JP | 4210934 | B2 | 1/2009 |

OTHER PUBLICATIONS

Written Opinion issued in Intl. Appln. No. PCT/JP2015/062968, dated Jul. 21, 2015.

* cited by examiner

PITCH INFORMATION GENERATION DEVICE, PITCH INFORMATION GENERATION METHOD, AND COMPUTER-READABLE RECORDING MEDIUM THEREFOR

BACKGROUND

A widely known technique for detecting information on sound pitches (hereinafter referred to as "pitch information") from sound signals is, for example, using autocorrelation to detect the pitch information. Another known method is identifying the pitch information from envelopes of input sound signals, as disclosed for example in Patent Document 1 (Japanese Patent No. 4210934). Patent Document 2 (Japanese Patent Application Laid-Open Publication No. 11-311988) discloses employing multiple pitch detectors to detect the multiple pieces of pitch information and selecting the optimum piece among them.

Some sound signals, however, include a large number of frequency components of overtones in a particular sound range, and at the same time, contain erratic waveform peaks in a different sound range of those sound signals.

The technique in Patent Document 1 generates an envelope that follows, at a predetermined time constant, an input waveform of a sound signal, and puts the envelope on hold at a timing where the input waveform crosses the zero line, and at a later timing where the input waveform exceeds the level of the envelope on hold again generates the envelope that follows the input waveform. Sound signals in general include peaks corresponding to fundamental tones and also other peaks (e.g., peaks corresponding to overtones or harmonics), and the pitch of a sound signal is defined by peak intervals (periods) of the fundamental tones. For this reason, envelopes must appropriately outline the peaks of the fundamental tones. But when the technique of Patent Document 1 is applied, an envelope sharply attenuates if a time constant is set to a small value, and hence, the envelope would be held at small amplitude (intensity). This in turn likely causes erroneous detection of peaks different from peaks that are the primary target corresponding to the fundamental tones, resulting in failure to detect a pitch of a sound signal with a high degree of accuracy in a sound range that contains a number of overtone frequency components. In contrast, if the time constant is set to a large value, the envelope attenuates slowly, the envelope is held at large amplitude, and there will be lower probability of erroneous detection of peaks different from the primary target peaks. In a sound range where peaks tend to be erratic, however, the peaks of the fundamental tones may fall below the hold level of the waveform, and a pitch cannot be accurately detected in such a case. Thus, with the technique of Patent Document 1, only in a limited range of frequencies can a pitch be detected with a high degree of accuracy.

A problem with using autocorrelation is that a larger amount of calculation is involved compared to using a method of identifying pitch information based on an envelope. In such cases where frequency characteristics of the fundamental tones are unlikely to appear in a waveform, as in the lowest tone of pianos, or when overtones do not appear at simple integer multiples of the fundamental tones, which otherwise are supposed to appear at the integer multiples (so called "inharmonicity"), a waveform from a peak to a subsequent peak for fundamental tones does not necessarily match that from the subsequent peak to a peak after the subsequent peak, and detecting pitch information with autocorrelation might result in failure. The pitch detectors employed in the technique of Patent Document 2 each detect pitch information based on correlation between a predetermined period of an input waveform (template waveform) and the input waveform. Therefore, in such cases where frequency characteristics of fundamental tones are unlikely to appear in a waveform, a problem that is similar to that in the case of using autocorrelation might arise.

With consideration of the above-described circumstances, the present invention has as an object to generate highly accurate pitch information of sound signals for a wider sound range with a smaller amount of calculation.

SUMMARY

One aspect of the present invention is a pitch information generation device that can solve the abovementioned problems. The present device is configured to generate pitch information indicating a pitch of a sound signal and includes an input device, a first envelope generator, a second envelope generator, and a pitch information identifier.

The input device is configured to receive a sound signal. The input device can be a microphone that collects sound.

The first envelope generator is configured to generate a first envelope, for a first sound range, that attenuates at a first rate of change from a detected value corresponding to a peak in the received sound signal.

The second envelope generator is configured to generate a second envelope, for a second predetermined sound range having a higher frequency than the first predetermined sound range, that attenuates from a detected value corresponding to a peak in the received sound signal at a second rate of change. The second rate of change is greater than the first rate of change.

The pitch information identifier is configured to identify the pitch information based on the first envelope and the second envelope.

According to this aspect, it is possible to generate pitch information for a wide sound range with a small amount of calculation and a high degree of accuracy since the pitch information generating device identifies pitch information by generating an envelope that attenuates at a rate of change corresponding to a sound range, based on a detected value corresponding to a peak of a sound signal. An example of a rate of change is a "time constant".

The pitch information generation device can include a frequency characteristics adjuster configured to apply to the received sound signal a processing that emphasizes frequency components corresponding to the first sound range, to supply the processed sound signal to the first envelope generator. The frequency characteristics adjuster can be a filter. In this aspect, in a sound range with relatively low frequency, an envelope is generated after a sound signal has undergone a processing that emphasizes frequency components corresponding to the sound range. Accordingly, even in a case where the frequency characteristics are unlikely to appear in a sound signal, it is possible to detect pitch information with a higher degree of accuracy compared to when the sound signal has not undergone such processing.

The first envelope generator can generate a detected value corresponding to the peak by multiplying the sound signal by a first coefficient, and the second envelope generator can generate a detected value corresponding to the peak by multiplying the sound signal by a second coefficient, which is smaller than the first coefficient. In this aspect, with respect to a sound range with a high frequency, a detected value that accords with a peak is generated using a smaller coefficient (i.e., gain is reduced) compared to that to a sound range with a low frequency. Therefore, it is possible to reduce the erratic nature of peaks of a waveform of a sound signal.

The pitch information identifier can include a first pitch information generator, a second pitch information generator, and a selector. The first pitch information generator is configured to generate first pitch information indicating a pitch of the received sound signal, in a case where the pitch is identifiable based on a first envelope. The second pitch information generator is configured to output second pitch information indicating a pitch of the received sound signal, in a case where the pitch is identifiable based on the second envelope. The selector is configured to output the second pitch information as the pitch information in a case where both the first pitch information and the second pitch information are generated.

In this aspect, when both pitch information corresponding to a sound range with a low frequency (first pitch information) and pitch information corresponding to a sound range with a high frequency (second pitch information) are generated, the second pitch information is selected. The second pitch information can be based on a second envelope generated using a second rate of change that has a larger degree of change per unit time compared to a first rate of change that is used in the generation of a first envelope that serves as a basis of the generation of the first pitch information. The larger the degree of change in a waveform of an envelope is, the faster the response speed is, and therefore, the subsequent peak of a sound signal is easily captured. Thus, it is possible to generate pitch information with a higher degree of accuracy.

The first sound range and the second sound range can partially overlap each other. If instead the sound range is set exclusively, in frequencies near the upper limit of the sound range that the first envelope generator covers and in frequencies near the lower limit of the sound range that the second envelope generator covers, peaks may not be outlined accurately depending on the waveform, resulting in the first pitch information generator and the second pitch information generator not being able to output pitch information. By allocating two adjacent sound ranges in an overlapping manner, it is possible to generate pitch information when one of the first pitch information generator or the second pitch information generator can generate pitch information, even when the other one of the first pitch information generator or second pitch information generator cannot generate the pitch information.

Another aspect of the present invention is a pitch information generation method of generating pitch information indicating a pitch of an input sound signal. The method includes a first envelope generating step of generating the first envelope, a second envelope generating step of generating the second envelope, and an identifying step of identifying the pitch information based on the first envelope and the second envelope. According to this method, the same effects as those of the abovementioned pitch information generation device can be obtained.

Another aspect of the present invention is a non-transitory computer-readable recording medium storing a program executable by a computer to execute the aforementioned method.

Another aspect of the present invention is a pitch information display device that includes the pitch information generation device, and a display device configured to display the pitch information identified by the pitch information identifier.

The pitch information generation device and the pitch information display device can be realized by hardware (electronic circuitry), such as a Digital Signal Processor (DSP), exclusively used for processing sounds, or realized in a general computer processing unit, such as a Central Processing Unit (CPU), and a program operating in coordination with each other. An aspect of a program according to the present invention causes a computer to function as the first envelope generator, the second envelope generator, and the pitch information identifier described above.

According to the abovementioned program the same effects as those of the pitch information generation device according to the present invention can be obtained. The program according to the present invention can be provided to users in a format stored in a non-transitory computer-readable recording medium and be installed in a computer, or can instead be distributed via a communication network and be installed in a computer.

DETAILED DESCRIPTION

The present invention relates to a technique for detecting information on sound pitches (fundamental frequencies) from sound signals.

Figure 1:
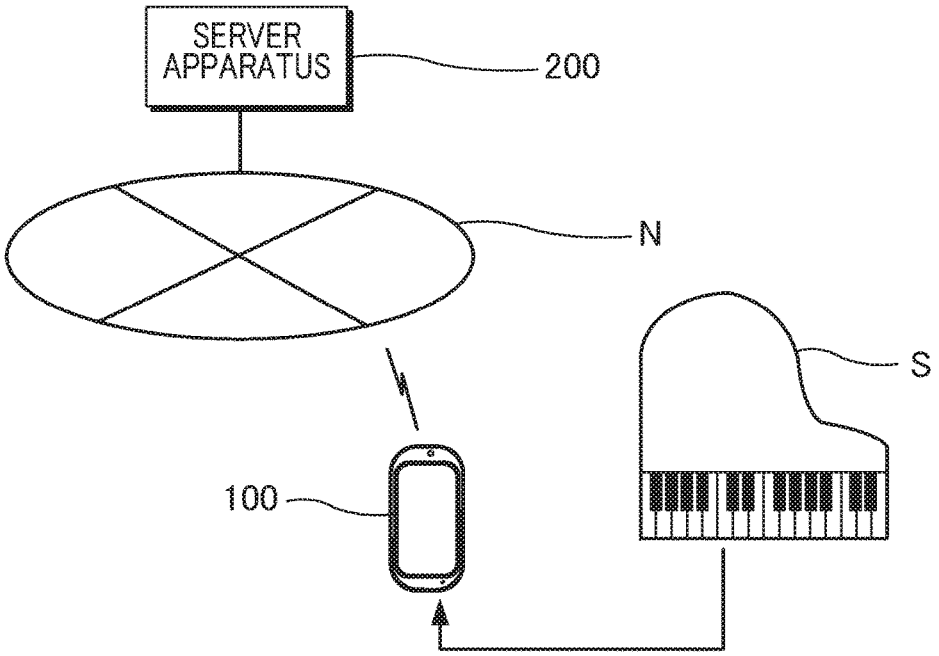
FIG. 1 is a schematic diagram for explaining a usage example of a pitch information generation device according to one embodiment of the present invention.

FIG. 1 is a schematic diagram for explaining a usage example of a pitch information generation device 100 according to one embodiment of the present invention. In the usage example shown in the figure, a pitch information generation program is downloadable from a server apparatus 200 to the pitch information generation device 100 via a communication network N, such as the Internet. By executing the pitch information generation program, the pitch information generation device 100 generates pitch information on a piano performance sound of an acoustic piano S. The pitch information generation device 100 then displays a screen that is based on the pitch information and that assists in tuning the acoustic piano S. The pitch information generation device 100 is configured as a smart phone, such as the iPhone (registered trademark), or other tablet terminals.

Figure 2:
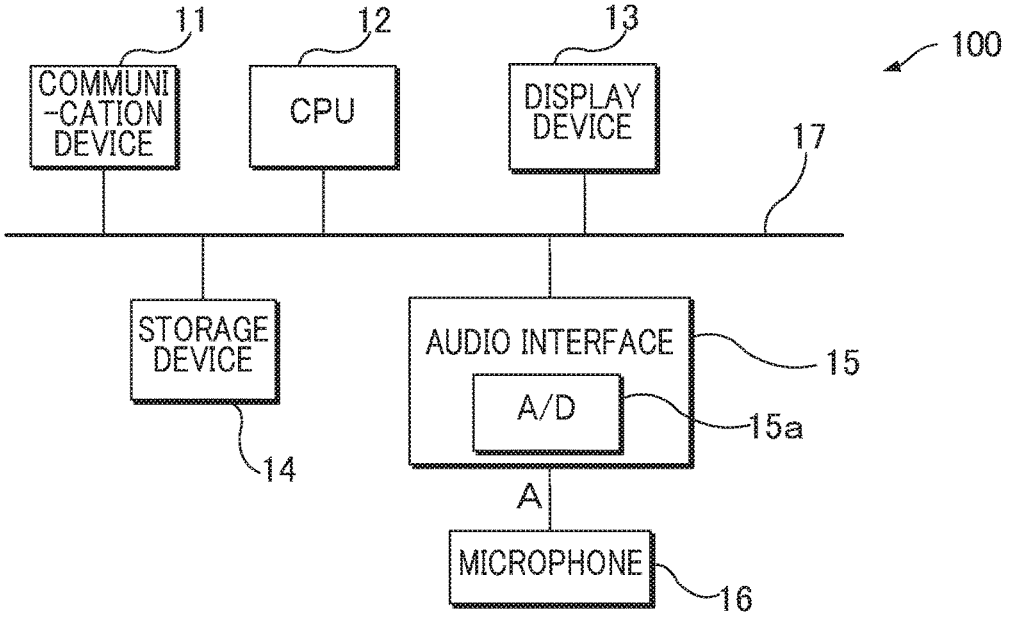
FIG. 2 is a block diagram showing a hardware configuration of the pitch information generation device.

FIG. 2 is a block diagram showing a hardware configuration of the pitch information generation device 100. As the figure shows, the pitch information generation device 100 includes a communication device 11 communicable with the communication network N either by radio or by wire, a display device 13 that accepts touch-panel input, a storage device 14, an audio interface 15, and a CPU 12 that controls each of these elements. The different elements are connected with one another via a bus 17. The pitch information generation device 100 further includes an input device, which can be a microphone 16, used to pick up sounds of a musical instrument, in particular a piano performance of the acoustic piano S. A sound signal A of the sound collected by the microphone 16 is supplied to the pitch information generation device 100 as an input waveform. The audio interface 15 converts the analog sound signal A, supplied from the microphone 16, to a digital signal by using an A/D 15*a*, and supplies the digital signal to the CPU 12. FIG. 2 illustrates a configuration where the microphone 16 is built in the pitch information generation device 100. But the microphone 16 can be configured to be externally connectable to the pitch information generation device 100.

A storage device 14 stores the pitch information generation program for generating pitch information from the sound signal A and various types of data. Any commonly known storage medium, such as a semiconductor recording medium and magnetic recording medium, can be used as the storage device 14. The pitch information generation program can be provided to users in a format stored in a computer-readable recording medium and be installed in the pitch information generation device 100. The recording medium is a non-transitory recording medium, and examples thereof other than the above include an optical recording medium (optical disc), such as a CD-ROM, and a USB (Universal Serial Bus) memory. The pitch information generation program may instead be distributed via the communication network N for example and be installed on the pitch information generation device 100.

Figure 3:
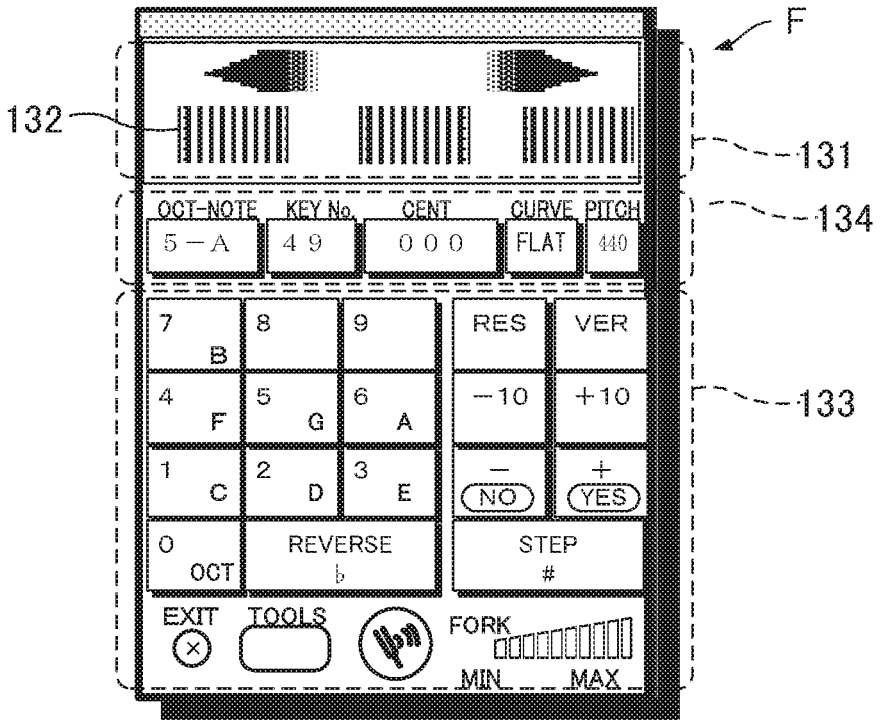
FIG. 3 is a diagram showing an example display screen of the pitch information generation device.

FIG. 3 is an example of what is displayed on a display device 13 of the pitch information generation device 100 when the pitch information generation program is executed. An indicator display device 131 that displays an indicator 132 is provided on a display screen F, the indicator 132 indicating a phase relation (difference between frequencies) between a frequency of a key that is the object of tuning (i.e., a frequency that is the target of tuning, hereinafter referred to as a "target frequency") and a frequency of a sound signal A. The indicator 132 is the result of visualizing the periodicity of the sound signal A in two levels of density (periodic-patterning). When a phase of a target frequency and a phase of a frequency of the sound signal A match, the indicator 132 is displayed to appear to be stopping at a certain point, whereas when a frequency of the sound signal A does not match a target frequency, the indicator 132 is displayed to appear to be flowing or moving in or above the indicator display device 13. An operator plays a piano performance sound by pressing one of the keys of the keyboard of the acoustic piano S that is to be tuned. By referring to the indicator 132 displayed on the display device 13 in response to a sound signal of the piano performance sound, the operator then tunes the acoustic piano S so that the indicator 132 stops.

An operation input device 133 is also displayed on the display screen F, the operation input device 133 including, for example, a group of button images that are used to input information, such as figures and notes (A to F), and an exit button image. The operator can carry out an input operation by, for example, touching the button images displayed on the screen. A parameter display device 134 displays setting and measurement information of the various parameters related to a frequency of the sound signal A. The parameters displayed on the parameter display device 134 include "OCT-NOTE" that indicates an octave and a note corresponding to a frequency of the sound signal A, "KEY No." that indicates the key number thereof, "CENT" that indicates the degree of difference from the tuning curve, "CURVE" that indicates a measurement curve selected as the measurement standard and "PITCH" (reference frequency) that corresponds to the key number "49". A key number is a number unique to each key of a piano keyboard (88 keys) that is assigned from the lowest key to the highest key in the order of 1 to 88. A reference frequency corresponding to the key number "49" is a value predetermined by the operator from among 440 Hz, 441 Hz, 442 Hz, etc., and formal frequencies of the other key numbers are determined based on this reference frequency. A formal frequency is a value determined for each pitch, and it may be determined by table lookup or calculation.

In the present embodiment, the pitch information generation device 100 generates pitch information of the sound signal A of a sound emitted when a keyboard key is pressed, and then displays, on the display screen F, a key number corresponding to the generated pitch information as "KEY No." and an octave and a note corresponding to the key number as "OCT-NOTE". The key number displayed here as "KEY No." is identified based on the formal frequency that is the closest to the pitch information detected by the pitch information generation device 100, from among the formal frequencies corresponding to the different key numbers.

Figure 4:
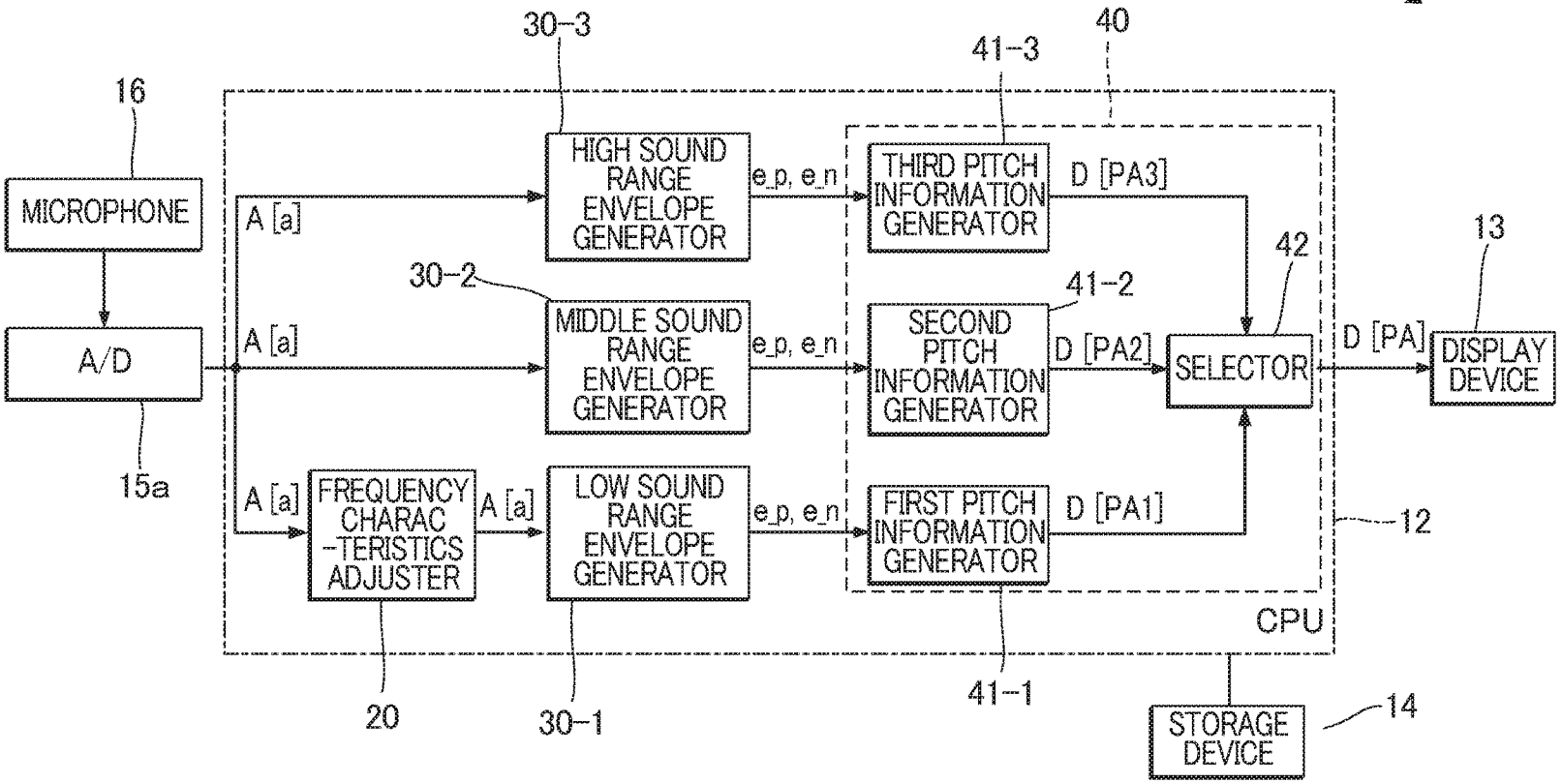
FIG. 4 is a functional block diagram showing a functional configuration of the pitch information generation device.

FIG. 4 is a diagram showing functional blocks realized through the execution of the pitch information generation program by the CPU 12 of the pitch information generation device. A sound signal A[a] is supplied to the pitch information generation device 100 via the microphone 16 and the A/D 15*a*. The sound signal A[a] is data indicating in time series an intensity (amplitude or power) of a waveform obtained by sampling, for each sampling period of the A/D 15*a*, a time-domain waveform of a sound. The pitch information generation device 100 identifies and outputs pitch information D[PA] from the sound signal A[a] and displays it on the display device 13. The pitch information D[PA] is information related to a pitch PA of the sound signal A[a].

By executing the pitch information generation program stored in the storage device 14, the CPU 12 functions as multiple elements (a frequency characteristics adjuster 20, a low sound range envelope generator 30-1, a middle sound range envelope generator 30-2, a high sound range envelope generator 30-3 and a pitch information identifier 40). A configuration where a hardware (circuitry) exclusively used for processing the sound signal A[a], such as a DSP, realizes the different elements of the CPU 12, and a configuration where the different elements of the CPU 12 are dispersedly mounted on multiple integrated circuits are also possible.

The low sound range envelope generator 30-1 generates a first envelope from the sound signal A[a] for a low sound range between 20 Hz and 200 Hz inclusive. The middle sound range envelope generator 30-2 generates a second envelope from the sound signal A[a] for a middle sound range between 100 Hz and 1000 Hz inclusive. The high sound range envelope generator 30-3 generates a third envelope from the sound signal A[a] for a high sound range between 700 Hz and 5000 Hz inclusive. The low sound range and the middle sound range partially overlap each other, and the middle sound range and the high sound range partially overlap each other. In other words, the middle sound range includes a sound range with frequencies higher than those of the low sound range, and the high sound range includes a sound range with frequencies higher than those of the middle sound range.

The sound signal A[a] supplied to the pitch information generation device 100 is supplied to each of the frequency characteristics adjuster 20, the middle sound range envelope generator 30-2 and the high sound range envelope generator 30-3. The frequency characteristics adjuster 20 applies to the sound signal A[a] a processing that emphasizes frequency components corresponding to a part or all of the low sound range (20 Hz to 200 Hz) and supplies the outcome to the low sound range envelope generator 30-1. The frequency characteristics adjuster 20 may be low-pass filters or high-cut filters, for example.

Figure 5:
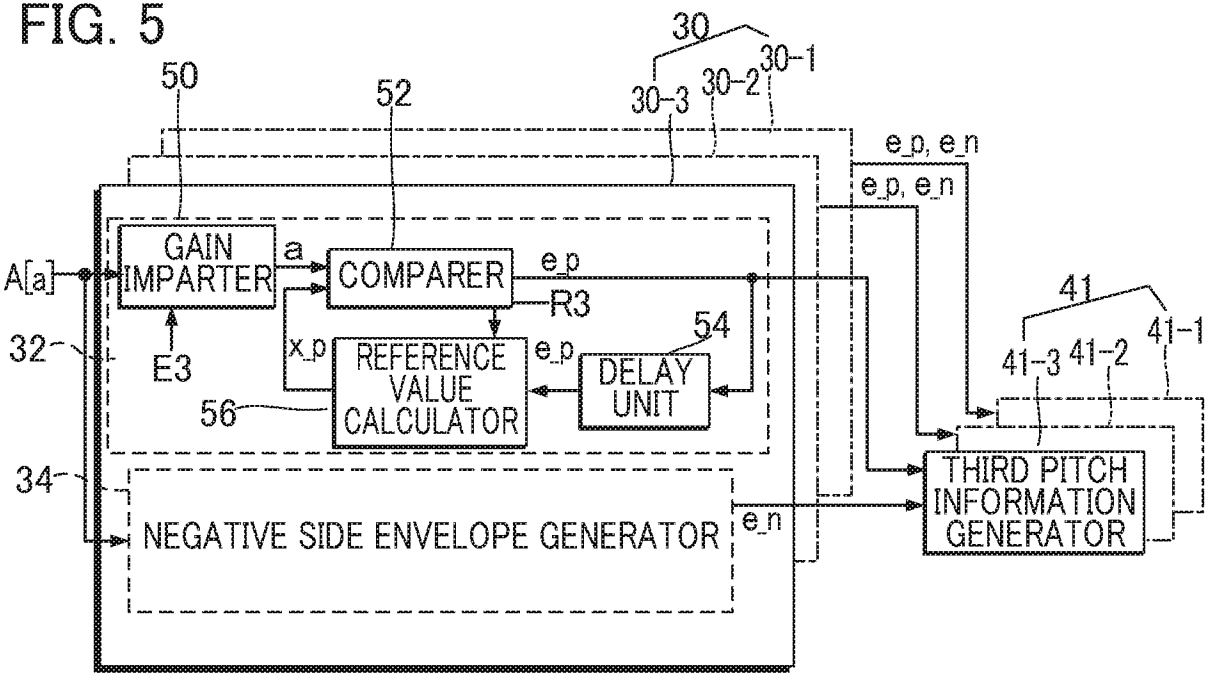
FIG. 5 is a functional block diagram showing functional configurations of envelope generators (high sound range envelope generator, middle sound range envelope generator, and low sound range envelope generator).

FIG. 5 is a functional block diagram of the different envelope generators. Each of the low sound range envelope generator 30-1, the middle sound range envelope generator 30-2, and the high sound range envelope generator 30-3 (as a group referred to as the "envelope generators 30" where appropriate hereinafter) generates an envelope containing a sequence of detected values (e_p) or detected values (e_n) that change over time from an intensity a of each peak of the sound signal A[a]. Each envelope generator 30 is formed of a positive side envelope generator 32 and a negative side envelope generator 34. In the below description, a reference sign with a subscript "_p" attached denotes an element that relates to the positive side envelope generator 32 (the intensity a of a positive number) and a reference sign with a subscript "_n" attached denotes an element that relates to the negative side envelope generator 34 (the intensity a of a negative number).

Figure 6:
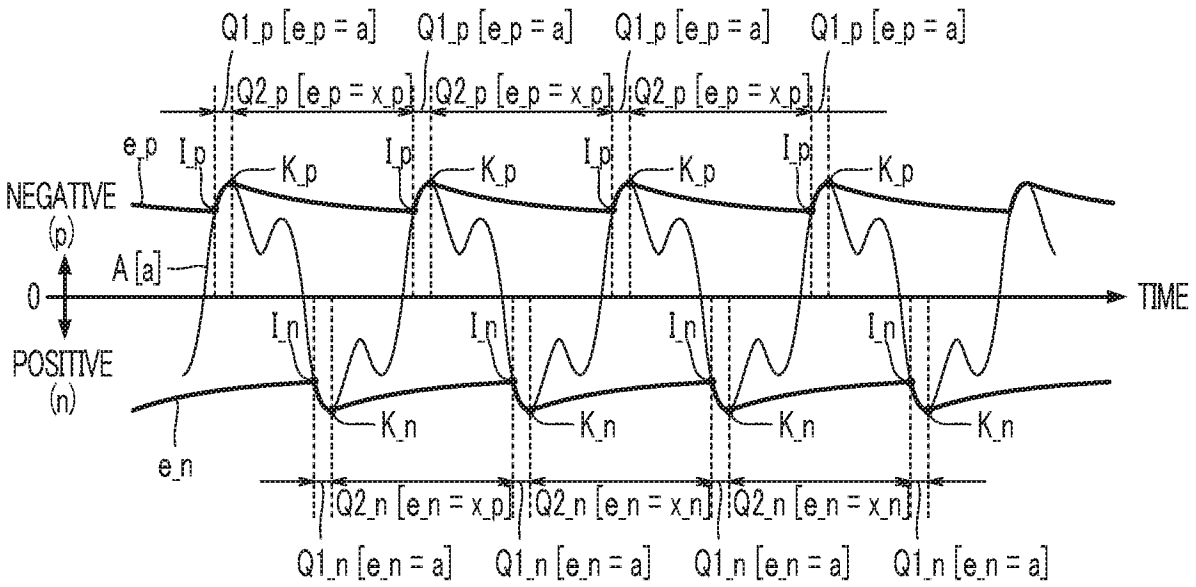
FIG. 6 is a schematic diagram for explaining an operation of each envelope generator.

FIG. 6 is a timing chart for explaining an operation of each envelope generator 30. As FIG. 6 shows, the positive side envelope generator 32 generates a positive side envelope (a sequence of the detected values e_p) that attenuates at a rate of change R from peaks K_p, the intensity a of a positive number (or more precisely, that attenuates from detected values corresponding to the peaks K_p), within the sound signal A[a]. The negative side envelope generator 34 generates in turn a negative side envelope (a sequence of the detected values e_n) that attenuates at a rate of change R from peaks K_n, the intensity a of a negative number (or more precisely, that attenuates detected values corresponding to the peaks K_n), within the sound signal A[a].

As FIG. 5 shows, the positive side envelope generator 32 of the high sound range envelope generator 30-3 is configured to include a gain imparter 50, a comparer 52, a delay unit 54, and a reference value calculator 56. The gain imparter 50 multiplies, by a coefficient E3, the intensity a that is a positive number and that is within the sound signal A[a] and outputs the outcome. The reference value calculator 56 sequentially calculates a reference value x_p. The comparer 52 sequentially compares the reference value x_p calculated by the reference value calculator 56 and the intensity a of the sound signal A[a] output from the gain imparter 50, and selects the larger of the reference value x_p and the intensity a as the detected value e_p. Accordingly, as FIG. 6 shows, the intensity a is sequentially selected as the detected value e_p in section Q1_p where the intensity a is greater than the reference value x_p at the peaks K_p on the positive side of the sound signal A[a], whereas the reference value x_p is sequentially selected as the detected value e_p in section Q2_p where the reference value x_p is greater than the intensity a. The detected value e_p is then supplied to the pitch information identifier 40. As FIG. 5 shows, the detected value e_p is supplied to the reference value calculator 56 after being delayed by a predetermined length of time (for example, by a time length of one sample of the sound signal A[a]) by the delay unit 54.

The reference value calculator 56 calculates the reference value x_p from the detected value e_p that is sequentially selected by the comparer 52 and a rate of change R3. More specifically, the reference value calculator 56 is a multiplier that sequentially calculates, as the reference value x_p, the multiplied value of the detected value e_p and the rate of change R3 (in this embodiment a coefficient in specific terms). The coefficient is set to a positive number less than 1. Accordingly, in the section Q2_p shown in FIG. 6 where the reference value x_p is greater than the intensity a, the detected value e_p detected by the comparer 52 (the reference value x_p) attenuates over time at a speed corresponding to the rate of change R3 from the intensity a (maximal value) of a peak K_p on the positive side of the sound signal A[a]. The greater the rate of change R3 is, the sharper the change over time in the detected value e_p becomes, and the smaller the rate of change R3 is (the closer the coefficient is to 1), the slower the change over time in the detected value e_p becomes. In other words, the rate of change R3 is understood as indicating the degree of change per unit time (i.e., the speed of change) in the detected values e_p.

Similar to the positive side envelope generator 32, the negative side envelope generator 34 is configured to include the gain imparter 50, the comparer 52, the delay unit 54, and the reference value calculator 56. But the relationships (small and large, positive and negative) between the different values become the opposite of those of the positive side envelope generator 32. More specifically, the reference value x_n that the reference value calculator 56 of the negative side processor 34 calculates is a negative number, and the comparer 52 sequentially selects as the detected value e_n the smaller of the reference value x_n and the intensity a of the sound signal A[a] (i.e., the one with a larger absolute value). In other words, as FIG. 6 shows, the intensity a is selected as a detected value e_n in section Q1_n where the intensity a is smaller than a reference value x_n at a peak K_n on the negative side of the sound signal A[a], whereas the reference value x_n is selected as a detected value e_n in section Q2_n where a reference value x_n is smaller than the intensity a. The rate of change R3 is common with the positive side envelope generator 32 (a coefficient that is a positive number less than 1). Accordingly, in the section Q2_n shown in FIG. 6, the detected value e_n (the reference value x_n) attenuates overtime at a speed corresponding to the rate of change R3 from the intensity a (minimal value) of a peak K_n on the negative side of the sound signal A[a].

The middle sound range envelope generator 30-2 and the low sound range envelope generator envelope generator 30-1 have a similar configuration as the high sound range envelope generator 30-3 shown in FIG. 5. The middle sound range envelope generator 30-2 and the low sound range envelope generator 30-1, however, each use a rate of change R2 and R1, respectively, that are different from the rate of change R3 that the high sound range envelope generator 30-3 uses to generate an envelope. To be more specific, the rate of change R2 that the reference value calculator 56 of the positive side envelope generator 32 (or the negative side envelope generator 34) of the middle sound range envelope generator 30-2 uses is smaller than the rate of change R3 that the reference value calculator 56 of the positive side envelope generator 32 (or the negative side envelope generator 34) of the high sound range envelope generator 30-3 uses. The rate of change R1 that the reference value calculator 56 of the positive side envelope generator 32 (or the negative side envelope generator 34) of the low sound range envelope generator 30-1 uses is even smaller than the rate of change R2 that the reference value calculator 56 of the positive side envelope generator 32 (or the negative side envelope generator 34) of the middle sound range envelope generator 30-2 uses (i.e., R3>R2>R1). In this manner, each of the rates of change R1, R2, and R3 is set according to the sound range the corresponding envelope generator 30 covers (low sound range, middle sound range, or high sound range).

The gain imparter 50 included in the low sound range envelope generator 30-1 uses a coefficient E1, and the gain imparter 50 included in the middle sound range envelope generator 30-2 uses a coefficient E2, with both the coefficient E1 and E2 differing from the coefficient E3 by which the intensity a of the sound signal A[a] is multiplied in the gain imparter 50 of the high sound range envelope generator 30-3. In the present embodiment, the coefficient E1, which the gain imparter 50 of the positive side envelope generator 32 (or the negative side envelope generator 34) in the low sound range envelope generator 30-1 uses, and the coefficient E2, which the gain imparter 50 of the positive side envelope generator 32 (or the negative side envelope generator 34) in the middle sound range envelope generator 30-2 uses, are set to "1", whereas the coefficient E3, which the gain imparter 50 of the positive side envelope generator 32 (or negative side envelope generator 34) in the high sound range envelope generator 30-3 uses, is set to a positive number less than "1" (E3<E1=E2=1). In a sound range with a high frequency, the peaks of the sound signal A[a] tend to be more erratic compared to those in a sound range with a low frequency. In this embodiment, with respect to a sound range with a high frequency, a detected value corresponding to a peak K_p is generated using a coefficient with a smaller absolute value (i.e., gain is reduced) compared to that with respect to a sound range with a low frequency. Therefore, it is possible to reduce the erratic nature of the peaks of the waveform of the sound signal A[a].

In this way, the low sound range envelope generator 30-1, the middle sound range envelope generator 30-2, and the high sound range envelope generator 30-3 use different rates of change R1, R2, and R3, respectively, and different coefficients E1, E2, and E3, respectively. Consequently, a first envelope output from the low sound range envelope generator 30-1, a second envelope output from the middle sound range envelope generator 30-2, and a third envelope output from the high sound range envelope generator 30-3 are all different from one another, even when the same sound signal A[a] is input.

Figure 7A:
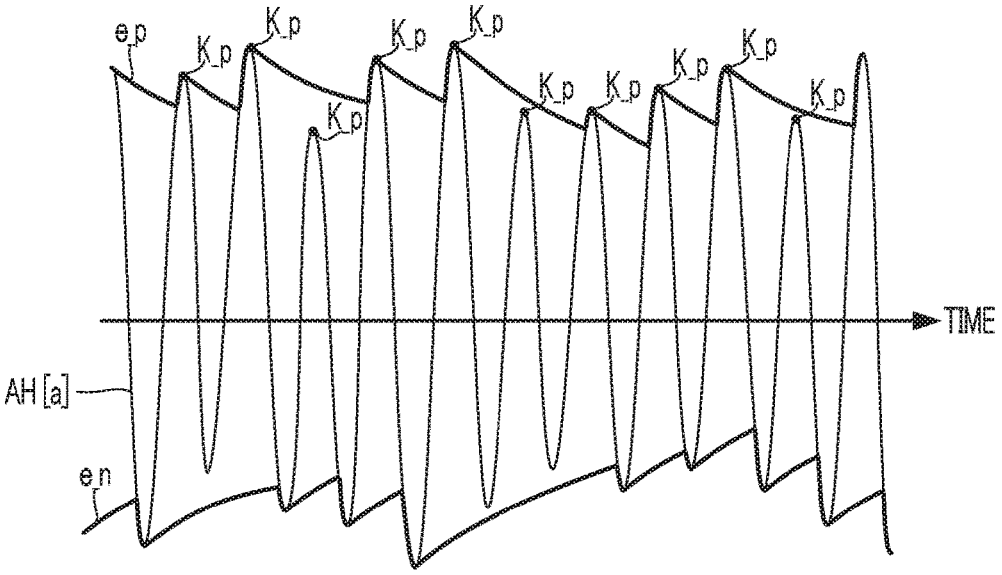
FIG. 7A is a schematic diagram for explaining effects of the embodiment.
Figure 7B:
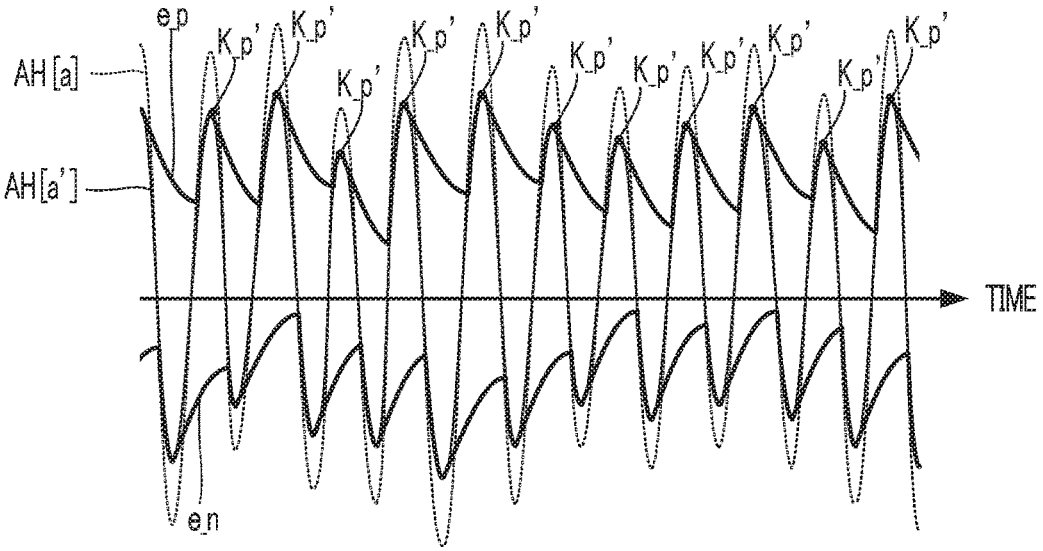
FIG. 7B is a schematic diagram for explaining effects of the embodiment.

FIGS. 7A and 7B are timing charts that indicate a comparison between a case where a sound signal AH[a] with a high frequency is input in the middle sound range envelope generator 30-2 (FIG. 7A) and a case where the same sound signal AH[a] with a high frequency is input in the high sound range envelope generator 30-3 (FIG. 7B). In FIG. 7B, for convenience, a waveform that indicates a sequence of the intensity a of the sound signal AH[a] is illustrated as a "dotted line AH[a]", and a waveform that indicates a sequence of the intensity a output from the gain imparter 50 is illustrated as a "solid line AH[a']". Meanwhile, in the middle sound range envelope generator 30-2, the coefficient E2 is "1", and therefore, in FIG. 7A, the sound signal AH[a] is simply illustrated as a "solid line AH[a]".

As shown in FIGS. 7A and 7B, in the sound signal AH[a] with a high frequency, the peaks K_p that appear in a cycle corresponding to the target pitch tend to be erratic. As a result, in a case where the sound signal AH[a] is input in the middle sound range envelope generator 30-2 that generates an envelope that slowly attenuates at the rate of change R2 from the peaks K_p, it is not possible to generate an envelope that outlines all the peaks K_p, as shown in FIG. 7A. In contrast, in a case where the sound signal AH[a] is input in the high sound range envelope generator 30-3 that generates an envelope that sharply attenuates at the rate of change R3, which is greater than the rate of change R2, from the detected values K_p' corresponding to the peaks, it is possible to generate an envelope that outlines all the detected values K_p' corresponding to the peaks, as shown in FIG. 7B. In this way, in order to generate an envelope from the sound signal AH[a], using the high sound range envelope generator 30-3 rather than using the middle sound range envelope generator 30-2 enables the more accurate detection of the pitch information D[PA] of the sound signal AH[a] with a high frequency.

Figure 8A:
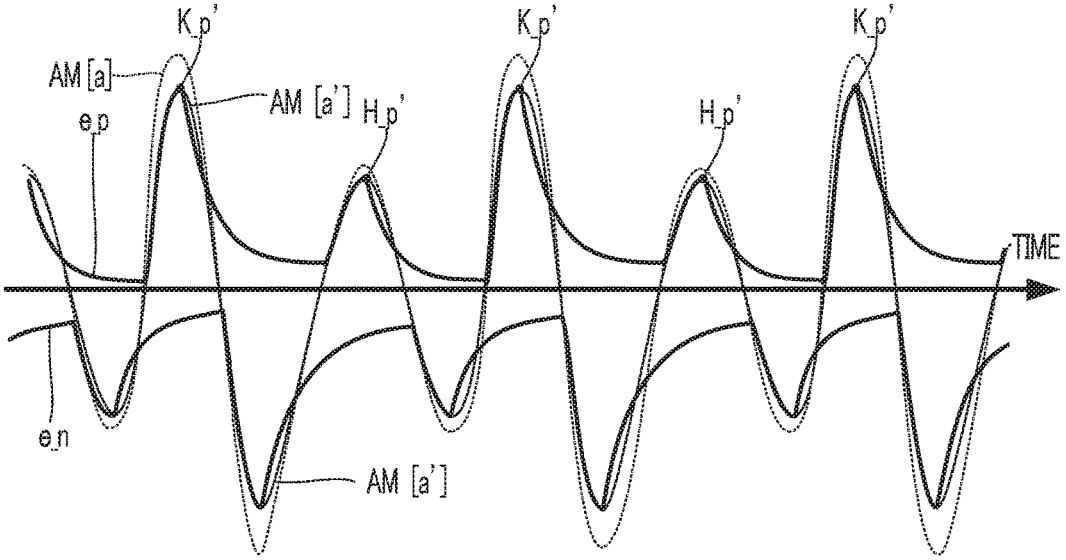
FIG. 8A is a schematic diagram for explaining effects of the embodiment.
Figure 8B:
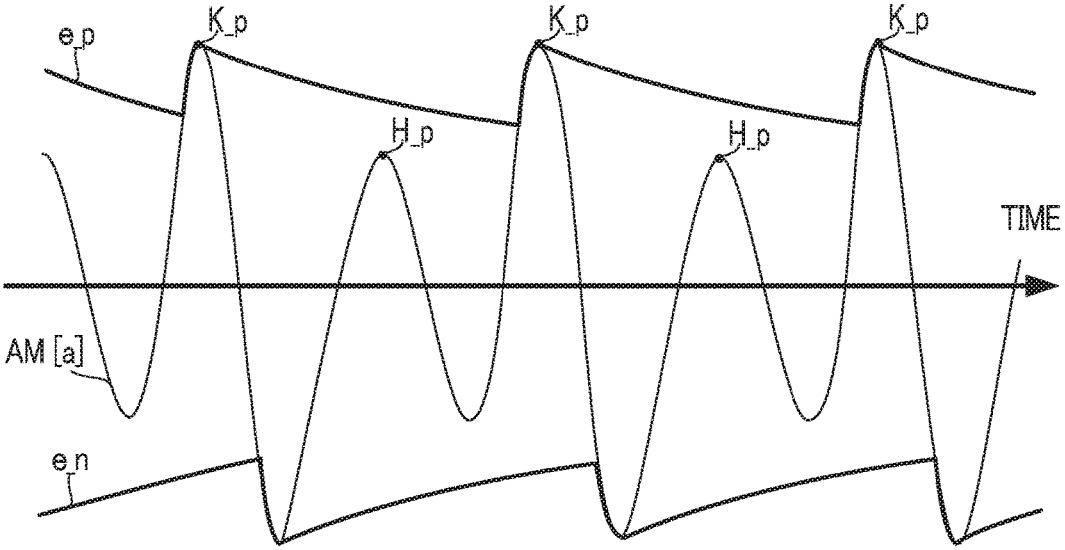
FIG. 8B is a schematic diagram for explaining effects of the embodiment.

As a further comparison, FIGS. 8A and 8B are timing charts that indicate a comparison between a case where a sound signal AM[a] that has a lower frequency than the sound signal AH[a] is input in the high sound range envelope generator 30-3 (FIG. 8A) and a case where the sound signal AM[a] is input in the middle sound range envelope generator 30-2 (FIG. 8B). In FIG. 8A, for convenience, a waveform that indicates a sequence of intensities a of the sound signal AM[a] is illustrated as a "dotted line AM[a]", and a waveform that indicates a sequence of intensities a output from the gain imparter 50 is illustrated as a "solid line AM[a']". Meanwhile, in the middle sound range envelope generator 30-2, the coefficient E2 is "1", and therefore, in FIG. 8B, the sound signal AM[a] is simply illustrated as a "solid line AM[a]".

As shown in FIGS. 8A and 8B, in the sound signal AM[a], peaks H_p appearing in a cycle corresponding to overtones (detected values H_p' that correspond to the peaks of the overtones) appear, beside the peaks K-p that appear in a cycle corresponding to an primary target pitch. As a result, in a case where the sound signal AM[a] is input in the high sound range envelope generator 30-3 that generates an envelope that sharply attenuates at a rate of change R3 from each of the detected values K_p' corresponding to the peaks, detected values H_p', corresponding to the peaks that correspond to the overtones, are simultaneously detected, and it is therefore not possible to generate an envelope that only envelopes the detected values K_p' corresponding to the peaks corresponding to a target pitch, as shown in FIG. 8A. In contrast, in a case where the sound signal AM[a] is input in the middle sound range envelope generator 30-2 that generates an envelope that slowly attenuates in the rate of change R2, which is smaller than the rate of change R3, from each of the peaks K_p, the peaks H_p corresponding to the overtones are not detected, as shown in FIG. 8B, and it is therefore possible to generate an envelope that only envelopes the peaks K_p corresponding to a target pitch. In this way, to generate an envelope from the sound signal AM[a], it is possible to more accurately detect the pitch information D[PA] of the sound signal AM[a], which has a lower frequency than the sound signal AH, by using the middle sound range envelope generator 30-2 rather than using the high sound range envelope generator 30-3.

The sound signal A[a] that is of a sound range close to the lowest tone of pianos (in the case of 88-key pianos, 27.5 Hz) is characterized by having a weak fundamental tone and including many overtones. As a result, there are cases where it is difficult, because of the influences of the overtones, to generate an envelope that represents a pitch corresponding to a fundamental tone that is the primary target. In view of this, in the present invention, the frequency characteristics adjuster 20 is provided, and the sound signal A[a] is supplied to the low sound range envelope generator 30-1 after it has undergone a processing that emphasizes a part or all of frequency components that correspond to a low sound range in the sound signal A[a].

Figure 9A:
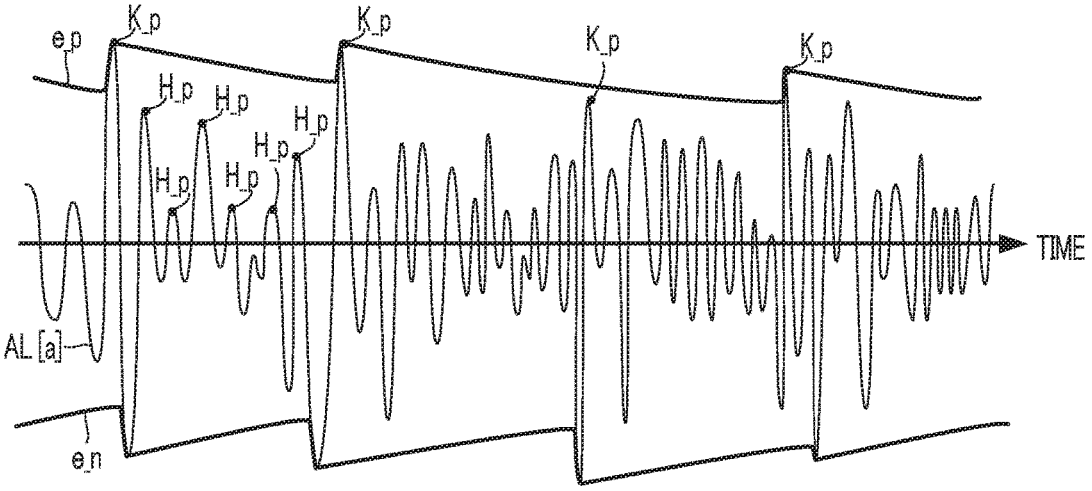
FIG. 9A is a schematic diagram for explaining effects of the embodiment.
Figure 9B:
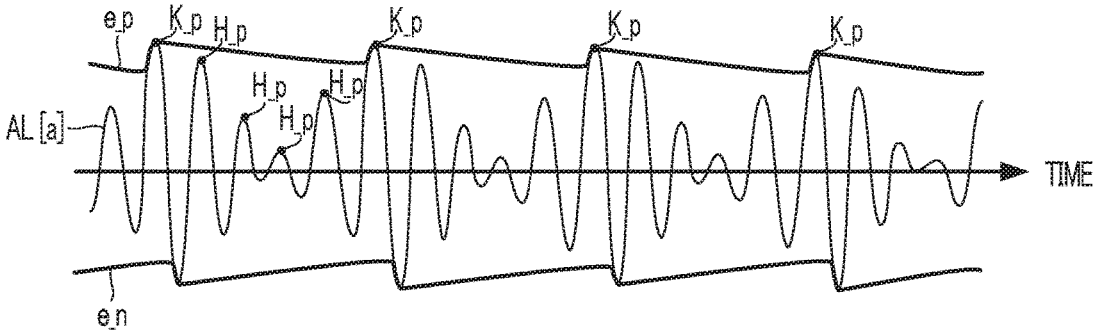
FIG. 9B is a schematic diagram for explaining effects of the embodiment.

FIGS. 9A and 9B are timing charts that indicate a comparison between a case where a sound signal AL[a] of a sound range with a low frequency is supplied to the low sound range envelope generator 30-1 without having undergone the processing by the frequency characteristics adjuster 20 (FIG. 9A) and a case where the sound signal AL[a] is supplied to the low sound range envelope generator 30-1 after having undergone the processing by the frequency characteristics adjuster 20 (FIG. 9B). As shown in FIG. 9A, the sound signal AL[a] of a sound range with a low frequency includes many peaks H_p corresponding to overtones that appear in a cycle corresponding to the pitch PA, and the peaks K_p corresponding to the fundamental tone that is the original target are unlikely appear. As a result, there are cases where it is not possible to generate an envelope that envelopes all of the peaks K_p when the sound signal AL[a] is supplied to the low sound range envelope generator 30-1 without having gone through the frequency characteristics adjuster 20. There is also the possibility that peaks H_p corresponding to the overtones will be detected in error. In contrast, as shown in FIG. 9B, in a case where the sound signal AL[a] is supplied to the low sound range envelope generator 30-1 after having undergone the processing by the frequency characteristics adjuster 20, the cycle corresponding to the frequency components of the pitch that is the primary target appear in a easily perceivable manner. In other words, the frequency components corresponding to the fundamental tone are emphasized, whereas the frequency components corresponding to the overtones are reduced. To summarize, it is possible to accurately detect the pitch information D[PA] of the sound signal AL[a] of a sound range with a low frequency by providing the low sound range envelope generator 30-1 with the frequency characteristics adjuster 20.

Next, the pitch information identifier 40 will be described. As FIG. 4 shows, the pitch information identifier 40 includes a first pitch information generator 41-1, a second pitch information generator 41-2, a third pitch information generator 41-3, and a selector 42. The first pitch information generator 41-1, the second pitch information generator 41-2, and the third pitch information generator 41-3 each, based on a corresponding one of the respective envelopes output from the low sound range envelope generator 30-1, the middle sound range envelope generator 30-2, and the high sound range envelope generator 30-3, generate a corresponding one of first pitch information D[PA1], second pitch information D[PA2], and third pitch information D[PA3], provided that the pitch PA of the sound signal A[a] is identifiable.

Next, a description will be given on a pitch information generation process. A pitch information generation process is a process carried out by each of the first to third pitch information generators 41-1 to 41-3 serving as functional elements of the CPU 12.

Figure 10:
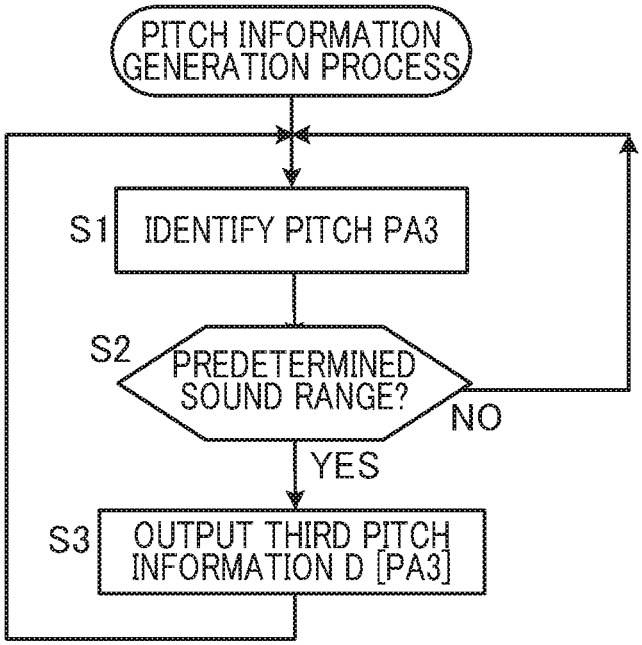
FIG. 10 is a flowchart showing a flow of a pitch information generation process.

FIG. 10 is a flow chart indicating a pitch information generation process that the third pitch information generator 41-3 executes. As FIG. 10 shows, the third pitch information generator 41-3 first identifies the third pitch information D[PA3] from the third envelope (detected values e_p or e_n) supplied from the high sound range envelope generator 30-3 (S1). As shown in FIG. 6 for example, the third pitch information generator 41-3 identifies points I_p where the relationship in value between the detected values e_p on the positive side and the intensity a of the sound signal A[a] is inverse (i.e., the point where the third envelope on the positive side meets the waveform of the sound signal A[a]), after each detected value e_p attenuates from each peak K_p. Subsequently, the third pitch information generator 41-3 identifies a pitch PA3_p of the sound signal A[a] from the intervals between respective points I_p (the cycle of the sound signal A[a]). Similarly, the third pitch information generator 41-3 identifies points I_n where the relationship in value between the detected values e_n on the negative side and the intensity a of the sound signal A[a] is inverse (i.e., the point where the third envelope on the negative side meets the waveform of the sound signal A[a]), after each detected value e_n attenuates from each peak K_n. Subsequently, the third pitch information generator 41-3 identifies a pitch PA3_n of the sound signal A[a] from the intervals between the respective points I_n (the cycle of the sound signal A[a]). Finally, the third pitch information generator 41-3 identifies a definite pitch PA3 from the pitch PA3_p and the pitch PA3_n. For example, a method by which the greater of the pitch PA3_p and the pitch PA3_n is identified as the pitch PA3 or a method by which the average of the pitch PA3_p and the pitch PA3_n is identified as the pitch PA3, may preferably be employed.

Subsequently, the third pitch information generator 41-3 determines whether or not the identified pitch PA3 is in a predetermined sound range (S2). More specifically, the third pitch information generator 41-3 determines whether or not the identified pitch PA3 is in the high sound range between 700 Hz and 5000 Hz inclusive. When this determination requirement is met (S2: YES), the third pitch information generator 41-3 outputs the third pitch information D[PA3] that indicates the pitch PA3 (S3). On the other hand, when the determination requirement is not met (S2: NO), the process returns to step S1 and the subsequent processing is carried out again.

As mentioned above, the high sound range envelope generator 30-3 is a functional element that can generate, with a high degree of accuracy, an envelope of the sound signal AH[a] of the high sound range. Accordingly, if the sound signal A[a] supplied to the high sound range envelope generator 30-3 is a sound signal AM[a] of the middle sound range, the pitch PA3 identified by the third pitch information generator 41-3 may be of low accuracy. For this reason, the third pitch information generator 41-3 supplies to the selector 42 the third pitch information D[PA3] that indicates the pitch PA3, only when the pitch PA3 is in the high sound range between 700 Hz and 5000 Hz inclusive. In other words, the third pitch information generator 41-3 generates the third pitch information D[PA3] that indicates the pitch PA3 of the sound signal A[a] provided that the pitch PA3 is identifiable based on the third envelope.

The first pitch information generator 41-1 and the second pitch information generator 41-2 also generate a pitch PA1 and a pitch PA2, respectively, and determine whether or not the generated pitch is in a predetermined sound range (The first pitch information generator 41-1 determines whether or not the pitch PA1 is in the low sound range between 20 Hz and 200 Hz inclusive. The second pitch information generator 41-2 determines whether or not the pitch PA2 is in the middle sound range between 100 Hz and 1000 Hz inclusive.). Only when the pitch PA1 is in the predetermined sound range does the first pitch information generator 41-1 supply to the selector 42 the first pitch information D[PA1] that indicates the pitch PAL Only when the pitch PA2 is in the predetermined sound range does the second pitch information generator 41-2 supply to the selector 42 the second pitch information D[PA2] that indicates the pitch PA2. In other words, the first pitch information generator 41-1 generates the first pitch information D[PA1] that indicates the pitch of the sound signal A[a] provided that the pitch PA1 is identifiable based on the first envelope. The second pitch information generator 41-2 generates the second pitch information D[PA2] that indicates the pitch of the sound signal A[a] provided that the pitch PA2 is identifiable based on the second envelope.

Figure 11:
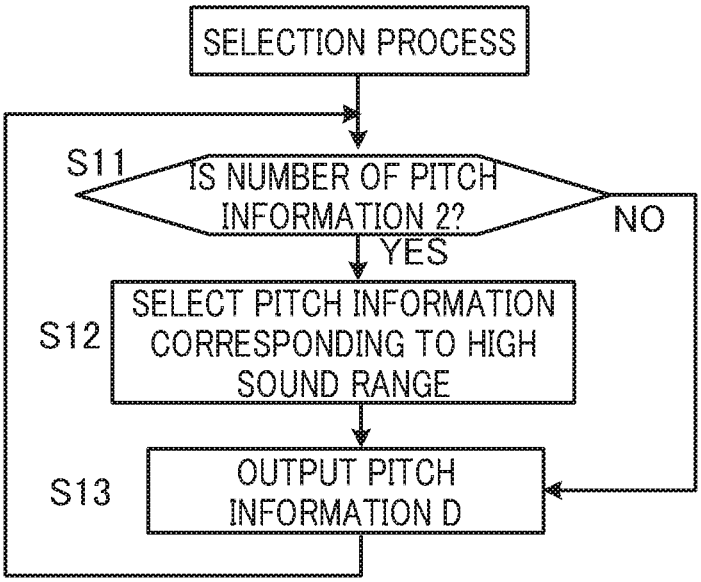
FIG. 11 is a flowchart showing a flow of a selection process.

FIG. 11 is a flowchart illustrating a selection process. A selection process is a process executed by the selector 42 serving as a functional block of the CPU 12. As shown in FIG. 11, the selector 42 first determines whether or not the number of pieces of pitch information that have been supplied is "2" (S11). As mentioned above, the low sound range between 20 Hz and 200 Hz inclusive and the middle sound range between 100 Hz and 1000 Hz inclusive partially overlap each other, and the middle sound range between 100 Hz and 1000 Hz inclusive and the high sound range between 700 Hz and 5000 Hz inclusive partially overlap each other. Accordingly, when the pitch PA of the sound signal A[a] is in a range between 100 Hz and 200 Hz inclusive for example, the first pitch information D[PA1] generated by the first pitch information generator 41-1 and the second pitch information D[PA2] generated by the second pitch information generator 41-2 are supplied to the selector 42. In addition, when the pitch PA of the sound signal A[a] is in a range where the different sound ranges do not overlap, the first pitch information D[PA1] generated by the first pitch information generator 41-1, the second pitch information D[PA2] generated by the second pitch information generator 41-2, or the third pitch information D[PA3] generated by the third pitch information generator 41-3 is supplied to the selector 42.

When the determination requirement of step S11 is not met (S11: NO), i.e., when the number of pieces of the supplied pitch information is "1", the selector 42 outputs the one piece of pitch information as a definite pitch information D[PA] (S13).

On the other hand, when the determination requirement of step S11 is met (S11: YES), i.e., when the number of pieces of the supplied pitch information is "2", the selector 42 selects, out of the two pieces of pitch information, the pitch information D[PA] that has been output by the pitch information generator 41 that covers a higher sound range (S12). More specifically, the selector 42 selects the second pitch information D[PA2] when two pieces of pitch information, that is, the first pitch information D[PA1] generated by the first pitch information generator 41-1 and the second pitch information D[PA2] generated by the second pitch information generator 41-2, are supplied to the selector 42. The selector 42 selects the third pitch information D[PA3] when another set of two pieces of pitch information, that is, the second pitch information D[PA2] generated by the second pitch information generator 41-2 and the third pitch information D[PA3] generated by the third pitch information generator 41-3, are supplied to the selector 42.

The greater the degree of change in waveform of an envelope is (i.e., the greater the rate of change R is), the faster the response speed is, and therefore, the subsequent peak K_p of a sound signal is easily captured. Consequently, the envelope generator 30 that uses a greater rate of change R can generate pitch information with higher accuracy, provided that the sound range is the same. Accordingly, in the present invention, when two pieces of pitch information D[PA] are identifiable in an overlapping sound range, the pitch information D[PA], the rate of change R of which has been used in generating the envelope that serves as the basis of the pitch information D[PA] is greater, is selected. If instead a sound range is set exclusively, in frequencies near the upper and lower limits of the sound range that the envelope generator 30 covers, the peaks cannot be outlined accurately, depending on the waveform, resulting in the pitch information generator 41 not being able to output pitch information. By allocating two adjacent sound ranges in an overlapping manner, it is possible to generate the pitch information D[PA] when one of the pitch information generators 41 can generate pitch information, even when the other pitch information generator 41 cannot generate pitch information.

Next, the selector 42 returns to step S11 after outputting the selected pitch information as the definite pitch information D[PA] (S13) and executes the selection process again for a new piece of pitch information D[PA].

After the execution of the abovementioned process, on the display screen F of the display device 13, a key number corresponding to the pitch PA indicated by the pitch information D[PA] output by the selector 42 is displayed as "KEY No.", and an octave and a note corresponding to the key number is displayed as "OCT-NOTE". In tuning a piano, the pitch of a sound signal of a piano performance sound obtained by the pressing of a keyboard key by the tuner is off the formal frequency corresponding to the key. The difference, however, is within 1 percent, below or above, of the formal frequency, and never deviates as much as the formal frequency of neighboring keys. Accordingly, based on the detected pitch, it is possible to identify a target frequency that is a tuning target and to identify the key number that corresponds to the target frequency. The operator tunes a key that is the object of tuning, so that the pitch PA indicated by the pitch information D[PA] output every time said key is pressed and the target frequency that has been automatically set match each other (i.e., so that the indicator 132 on the display screen F stops). When the operator ends tuning the current tuning-object key and plays a new sound by pressing another tuning-object key, a new piece of pitch information D[PA] is generated with respect to this sound signal A[a] and a target frequency is identified. On the display screen F, the key number displayed as "KEY No." and the octave and note displayed as "OCT-NOTE' switch to those corresponding to the newly identified target frequency. The operator plays the tuning-object key referring to the indicator 132 and tunes the tuning-object key so that the indicator 132 stops.

As described above, according to the pitch information generating device 100 of the present invention, it is possible to generate pitch information for a wide range of sound with a small amount of calculation and a high degree of accuracy since the pitch information generating device 100 identifies pitch information by generating an envelope that attenuates at the rate of change R corresponding to a sound range, based on the detected value corresponding to the peaks K_p of the sound signal A[a].

Moreover, since a key number, etc., that corresponds to a tuning-object key is automatically set, it is possible to set a tuning-object key with less burden, compared to when setting a tuning-object key by inputting the key number of the tuning-object key in the operation input device 133.

The abovementioned embodiment may be modified in various ways. The following are examples of specific modifications. Two or more of the following examples may be freely combined.

In a first modification, the method by which the reference value calculator 56 calculates the reference value x (x_p or x_n) from the rate of change R and the detected value e (e_p or e_n) may be changed as appropriate. For example, a configuration where the reference value x_p is calculated by subtracting the rate of change from the detected value e_p on the positive side and a configuration where the reference value x_n is calculated by adding the rate of change to the detected value e_n on the negative side may be adopted. In other words, as long as the reference value x is calculated so that it attenuates in a speed corresponding to a rate of change (the reference value x_p on the positive side decreasing, or the reference value x_n on the negative side increasing), the specific method by which the reference value x is calculated may be freely chosen. A preferable configuration is to set a rate of change with which the reference value x changes at a faster speed for the envelope generator 30 that covers a sound range with a higher frequency.

The rate of change R described in the abovementioned embodiment is provided as a coefficient that is used to multiply the output of the delay unit 54 by. The rate of change R, however, is not limited to such coefficient, and it may be any index that indicates a change in envelope per unit time. For example, the rate of change may be a so-called time constant, or if it is desirable to have the envelope change in a straight line, it may be the angle of the line.

In the abovementioned embodiment, each of the envelope generators 30 uses a single rate of change R, but in another embodiment, two or more different rates of change R may be used. For example, in a case where a value (absolute value) corresponding to the peak K_p or K_n is smaller than the intensity a of the sound signal A[a] as an effect of the gain imparter 50, it is preferable to switch from one rate of change R to another rate of change R where the change speed of an envelope becomes slower (i.e., attenuates more slowly), the switching being performed at a timing the envelope attenuating from a value corresponding to peak K_p or K_n crosses the waveform A[a] of the sound signal A (i.e., at a timing the detected value e_p or e_n (absolute value) of the envelope surpasses the intensity a of the sound signal A). According to this mode, it is possible to reduce the risk of erroneously detecting peaks (peaks appearing as a result of overtones and noises) other than peaks of a fundamental tone that is the primary target since the rate of change switches from a rate by which the envelope sharply attenuates to a rate by which the envelope slowly attenuates.

In each of the above embodiments, each of the envelope generators 30 was configured to include the positive side envelope generator 32 and the negative side envelope generator 34. But in another embodiment, it is also preferable to configure each of the envelope generators 30 to include either one of the positive side envelope generator 32 or the negative side envelope generator 34. For example, according to a configuration where each envelope generator 30 includes the positive side envelope generator 32 only, the pitch PA of the sound signal A is identified from the intervals between the respective points I_p detected from the detected values e_p on the positive side.

The pitch information D[PA] refers to information related to the pitch PA of the sound signal A, but in another embodiment, it is not limited to the pitch PA (frequency) of the sound signal A in terms of the above embodiments. For example, one preferable configuration is one where a cycle corresponding to the pitch PA (pitch cycle [i.e., time]) or a key number corresponding to the pitch PA is identified as the pitch information D.

In the above embodiment, a sound range that is the object of pitch information generation is divided into three sound ranges, a low sound range between 20 Hz and 200 Hz inclusive, a middle sound range between 100 Hz and 1000 Hz inclusive, and a high sound range between 700 Hz and 5000 Hz inclusive. But in another embodiment, the object sound range can be divided into two sound ranges or into four or more sound ranges. Accordingly, in the modified embodiment(s), the number of envelope generators 30 and pitch information generators 41 can be 2 or 4 or more. The sound ranges do not necessarily have to partially overlap. In such a case, the selector 42 does not have to be included in the pitch information generation device 100.

In other words, the pitch information generation device can include at least two envelope generators that respectively correspond to a "first sound range" and a "second sound range" that includes a sound range with a higher frequency than the "first sound range."

Additionally, it is not necessary that the "first sound range" and the "second range" be adjacent to each other (or consecutive). In other words, in a case where a sound range that is an object of pitch information generation is divided into three sound ranges (for example, into the low sound range, the middle sound range, and the high sound range), the "first sound range" may be the low sound range, and in this case the "second sound range" may be either the middle sound range or the high sound range. Alternatively, the "first sound range" may be the middle sound range, in which case the "second sound range" may be the high sound range. For example, when the middle sound range is assumed to be the "first sound range" and the high sound range the "second sound range", the middle sound range envelope generator 30-2 of the embodiment, with respect to the first sound range, functions as a first envelope generator that generates a first envelope that attenuates at the first rate of change (R2) from detected values corresponding to the peaks of a sound signal, and the high sound range envelope generator 30-3 of the embodiment, with respect to the second sound range, functions as a second envelope generator that generates a second envelope that attenuates at the second rate of change (R3) from detected values corresponding to the peaks of the sound signal. Similarly, the second pitch information generator 41-2 of the embodiment functions as a first pitch information generator that generates first pitch information indicating the pitch of the sound signal when the pitch is identifiable based on the first envelope, and the third pitch information generator 41-3 functions as a second pitch information generator that generates second pitch information indicating the pitch of the sound signal when the pitch is identifiable based on the second envelope.

Furthermore, when the low sound range is assumed to be the "first sound range" and the high sound range the "third sound range" for example, the first envelope generator 30-1 generates detected values corresponding to the peaks by multiplying a sound signal by the coefficient E1 (first coefficient), and the third envelope generator 30-3 generates detected values corresponding to the peaks by multiplying the sound signal by the coefficient E3 (second coefficient). In this case, the coefficient E3 (second coefficient) is smaller than the coefficient E1 (first coefficient). Furthermore, when the middle sound range is assumed to be the "second sound range" and the high sound range the "third sound range" for example, the second envelope generator 30-2 generates detected values corresponding to the peaks by multiplying a sound signal by the coefficient E2 (first coefficient), and the third envelope generator 30-3 generates detected values corresponding to the peaks by multiplying the sound signal by the coefficient E3 (second coefficient). In this case, the coefficient E3 (second coefficient) is smaller than the coefficient E2 (first coefficient).

The upper and lower limits in frequencies in the different sound ranges are just one example, and they may be changed as appropriate as long as the effects of the present invention are maintained.

The configuration where the gain imparter 50 is included in each of the low sound range envelope generator 30-1, the middle sound range envelope generator 30-2, and the high sound range envelope generator 30-3 can be changed as appropriate. For example, a preferable configuration can be one where the gain imparter 50 is included in only the high sound range envelope generator 30-3 (an envelope generator 30 covering the sound range with a higher frequency in a case where the entire sound range is divided into two sound ranges, and one or more envelope generators 30 including an envelope generator 30 covering the highest sound range in a case where the entire sound range is divided into four or more sound ranges). Alternatively, a configuration where none of the envelope generators 30 includes the gain imparter 50 can be adopted. Furthermore, a configuration where the frequency characteristics adjuster 20 is not included can be selected.

A coefficient used in the gain imparter 50 included in each envelope generator 30 in the above embodiment is "E3<E1=E2=1", but this coefficient can be changed as appropriate as long as the effects of the present invention are maintained.

In the above embodiment, the pitch PA is identified based on the intervals between respective points I_p, I_n. But instead, the pitch PA can be identified based on the intervals between respective peak K_p. Each envelope generator 30 is understood as an element that identifies a sequence of the detected values e in a way that the detected values e attenuate from the respective peaks K of the sound signal A[a] at a speed corresponding to the rate of change R (i.e., in a way that the angle of an envelope of the sound signal A[a] is controlled according to the rate of change R). A comparison between the reference value x and the intensity a of the embodiment is not an absolute requirement.

In the above embodiments, a key number corresponding to a key that is the object of tuning and other information are automatically set based on the definite pitch information D[PA] output from the selector 42. But an alternative configuration can have an operator input from the operation input device 133 to set a key number of a key that is the object of tuning. Carrying out tuning based on pitch information detected with a high degree of accuracy is possible since, in such a case also, the indicator 132 indicates a phase relation between the definite pitch information D[PA] output from the selector 42 and a target frequency corresponding to a set key number.

The pitch information generation device of the present invention may be applied, not only in detecting a pitch of a musical sound of pianos, but also in detecting a pitch of a musical sound of other musical instruments or of a singing voice. The pitch information generation device 100 is not limited to a smartphone or other tablet terminals but can be a desktop personal computer, a notebook personal computer, a Ultra-Mobile Personal Computer (UMPC), or a portable game machine.

DESCRIPTION OF REFERENCE SIGNS

100 . . . pitch information generation device, 11 . . . communication device 12 . . . CPU, 13 . . . display device, 14 . . . storage device, 15 . . . audio interface, 16 . . . microphone, 20 . . . frequency characteristics adjuster, 30-1 . . . low sound range envelope generator, 30-2 . . . middle sound range envelope generator, 30-3 . . . high sound range envelope generator, 32 . . . positive side envelope generator, 34 . . . negative side envelope generator, 40 . . . pitch information identifier, 41-1 . . . first pitch information generator, 41-2 . . . second pitch information generator, 41-3 . . . third pitch information generator, 42 . . . selector, 50 . . . gain imparter, 52 . . . comparer, 54 . . . delay unit, 56 . . . reference value calculator.

What is claimed is:

1. A pitch information generation device for generating pitch information indicating a pitch of a sound signal, the pitch information generation device comprising:

an input device configured to receive a sound signal;

a first envelope generator configured to generate a first time-series envelope, for a first predetermined sound range, that attenuates at a first rate of change from a detected value corresponding to a peak in the received sound signal;

a second envelope generator configured to generate a second time-series envelope, for a second predetermined sound range having a higher frequency than the first predetermined sound range, that attenuates from a detected value corresponding to a peak in the received sound signal at a second rate of change, wherein the second rate of change is greater than the first rate of change;

a pitch information identifier configured to identify the pitch information based on the first time-series envelope and the second time-series envelope; and a display device configured to display the pitch information identified by the pitch information identifier.

2. The pitch information generation device according to claim 1, further comprising a frequency characteristics adjuster configured to apply to the received sound signal a processing that emphasizes frequency components corresponding to the first predetermined sound range, to supply the processed sound signal to the first envelope generator.

3. The pitch information generation device according to claim 2, wherein the frequency characteristics adjuster comprises a filter.

4. The pitch information generation device according to claim 1, wherein:

the first envelope generator generates the detected value corresponding to the peak by multiplying the received sound signal by a first coefficient, the second envelope generator generates the detected value corresponding to the peak by multiplying the received sound signal by a second coefficient, and the second coefficient is smaller than the first coefficient.

5. The pitch information generation device according to claim 1, wherein the first predetermined sound range and the second predetermined sound range partially overlap with each other.

6. The pitch information generation device according to claim 1, wherein the pitch information identifier comprises:

a first pitch information generator configured to generate first pitch information indicating the pitch of the received sound signal, in a case where the pitch is identifiable based on the first time-series envelope;

a second pitch information generator configured to output second pitch information indicating the pitch of the sound signal, in a case where the pitch is identifiable based on the second time-series envelope; and a selector configured to output the second pitch information as the pitch information in a case where both the first pitch information and the second pitch information are generated.

7. The pitch information generation device according to claim 1, wherein the input device comprises a microphone that collects sound and outputs a sound signal.

8. A pitch information generation method of generating pitch information indicating a pitch of an input sound signal, the method comprising:

a first envelope generating step of generating a first time-series envelope, for a first predetermined sound range, that attenuates at a first rate of change from a detected value corresponding to a peak in the received sound signal;

a second envelope generating step of generating a second time-series envelope, for a second predetermined sound range having a higher frequency than the first predetermined sound range, that attenuates from a detected value corresponding to a peak in the received sound signal at a second rate of change, wherein the second rate of change is greater than the first rate of change;

a pitch identifying step of identifying the pitch information based on the first time-series envelope and the second time-series envelope; and a displaying step of displaying, in a display device, the pitch information identified by the pitch information identifier.

9. A non-transitory computer-readable recording medium storing a program executable by a computer to execute a method of generating pitch information indicating a pitch of an input sound signal, the method comprising:

a first envelope generating step of generating a first time-series envelope, for a first predetermined sound range, that attenuates at a first rate of change from a detected value corresponding to a peak in the input sound signal;

a second envelope generating step of generating a second time-series envelope, for a second predetermined sound range having a higher frequency than the first predetermined sound range, that attenuates from a detected value corresponding to a peak in the input sound signal at a second rate of change, wherein the second rate of change is greater than the first rate of change;

a pitch identifying step of identifying the pitch information based on the first time-series envelope and the second time-series envelope; and a displaying step of displaying, in a display device, the pitch information identified by the pitch information identifier.

* * * * *